US005424700A

United States Patent [19]

Santarelli

[11] Patent Number: 5,424,700

[45] Date of Patent: Jun. 13, 1995

[54] STARTER MOTOR CONTACTOR FOR A MOTOR VEHICLE INTERNAL COMBUSTION ENGINE

[75] Inventor: Virginio Santarelli, Meyzieu, France

[73] Assignee: Valeo Equipements Electriques Moteur, Creteil, France

[21] Appl. No.: 142,268

[22] Filed: Oct. 25, 1993

[30] Foreign Application Priority Data

Oct. 26, 1992 [FR] France ..... 92 12735

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS 1,653,823 12/1927 Pudelko .
2,850,602 9/1958 Breese et al. .
4,604,597 8/1986 Bogner et al. .
5,015,980 5/1991 Sugiyama .
5,175,524 12/1992 Gotoh ..... 335/126

FOREIGN PATENT DOCUMENTS 099998 2/1984 European Pat. Off. .
324262 7/1989 European Pat. Off. .
484291 5/1992 European Pat. Off. .
150669 9/1981 German Dem. Rep. .
407686 4/1924 Germany .

*Primary Examiner*—Lincoln Donovan
*Attorney, Agent, or Firm*—Morgan & Finnegan

[57] ABSTRACT

A contactor unit for a starter motor of an internal combustion engine starter has a casing which includes an end closure cap carrying two fixed contacts for electrical connection to the starter motor, together with a solenoid having a movable core and a solenoid coil for actuating the movable core, the latter being arranged to displace a movable contact axially into engagement with the fixed contacts. The movable contact defines a concave shape in facing relationship with at least one of the fixed contacts. The arrangement is such that there is effectively three-point contact between the movable and fixed contacts.

1 Claim, 2 Drawing Sheets

STARTER MOTOR CONTACTOR FOR A MOTOR VEHICLE INTERNAL COMBUSTION ENGINE

FIELD OF THE INVENTION

The present invention relates to a contactor for the starter motor of an internal combustion engine for a motor vehicle.

BACKGROUND OF THE INVENTION

Such a contactor, in general terms, includes a movable core of a solenoid, this core being connected at one end to a pivoting lever, its other end being connected to the driving element of the meshing device of the starter. During its displacement, the movable core displaces a movable electrical contact which is arranged to cooperate with fixed contacts, so as to make the electrical supply to the starter motor.

Despite all the precautions that may be taken during the manufacture of such a contactor, so as to ensure sealing which is as perfect as possible, it has been found that particles of dirt, which is generally of electrically insulating material, can still penetrate into the interior of the housing of the contactor, and may in particular become deposited on the fixed contacts of the latter, thus giving rise to electrical discontinuity and therefore failure of the starter system as a whole to function at all.

Experience shows that this situation is particularly frequent when the movable contact is flat and is arranged to engage with fixed contacts of the kind having terminal elements of generally spherical shape. In this connection, in such a context the mechanical, and therefore electrical, connection is obtained for each fixed contact at a single point, which is always the same point throughout operation of the contactor. It therefore only needs a few insulating particles to cause the malfunction described above to occur, with its consequent interruption of the electrical supply.

DISCUSSION OF THE INVENTION

The present invention aims to overcome the above mentioned drawbacks by providing a contactor for a starter of an internal combustion engine, comprising a closure cap carrying two fixed contacts for taking the electrical supply to the starter motor, a movable core actuated by a coil, the said movable core controlling, in particular, the axial displacement of a movable contact which is adapted to cooperate with the said fixed contacts, the movable contact defining a concave shape in facing relationship with at least one of the said fixed contacts characterised in that the movable contact has a recess on each of its two opposed faces.

According to a preferred feature of the invention, the said recesses extend in a direction defined by a plane of symmetry of the movable contact at right angles to the general axis of the contactor.

According to a further preferred feature of the invention, the movable contact has two projecting elements, each of which is aligned with a respective one of the two said recesses and disposed on the opposite face of the contact from the corresponding said recess.

According to another preferred feature of the invention, each said recess has a circular cross section having a radius which is smaller than the radius of the end portions of the fixed contacts.

According to yet another preferred feature of the invention, the said recesses and the said projecting elements are made by pressing.

The invention will be understood more clearly on a reading of the description of a preferred embodiment of the invention which follows, and which is given by way of example only and with reference to the accompanying drawings.

DESCRIPTION OF A PREFERRED EMBODIMENT OF THE INVENTION

Figure 1:
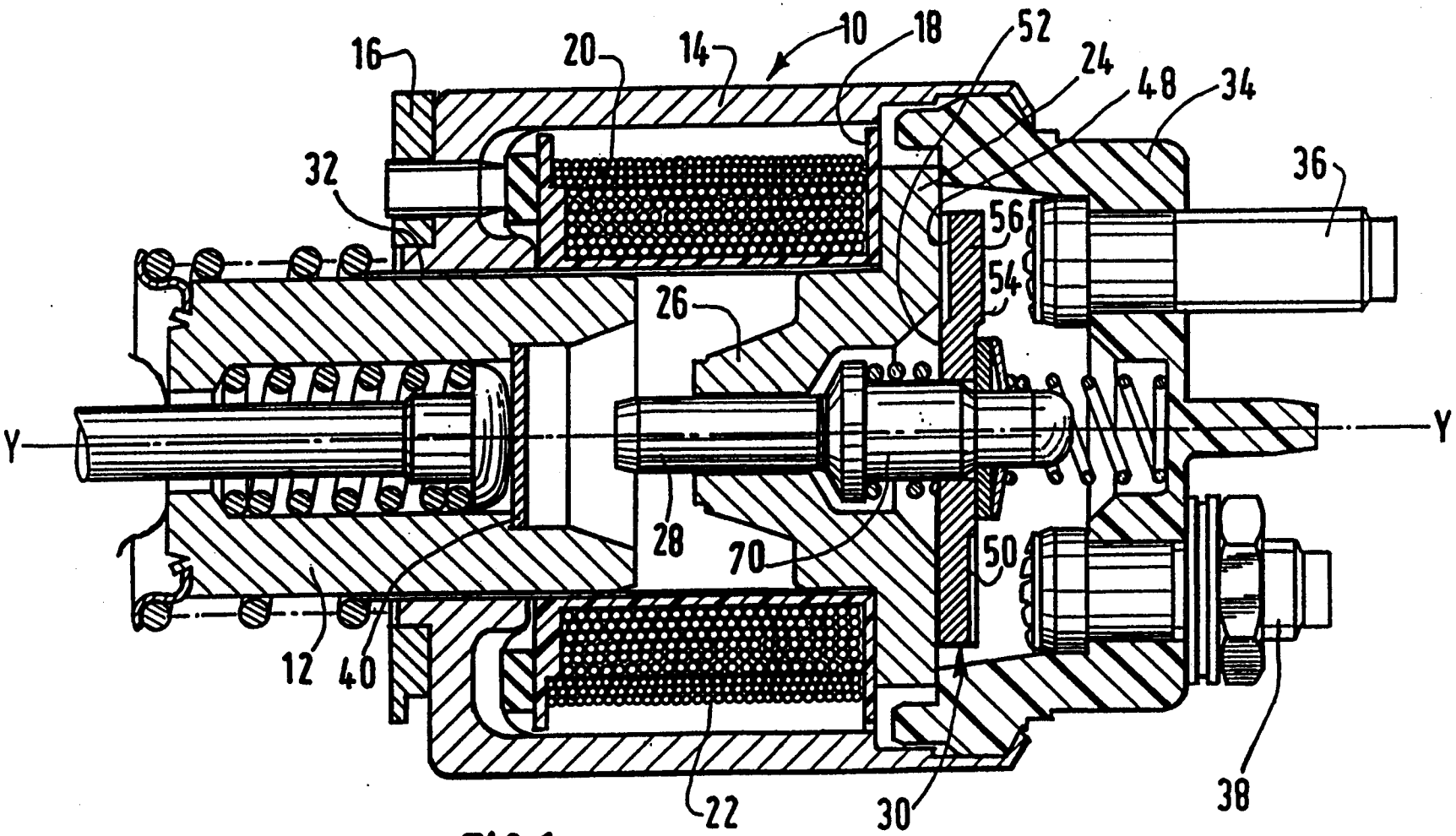
FIG. 1 is an axial cross sectional view of a contactor unit having a movable contact in accordance with the invention.

FIG. 1 shows an electromagnetic contactor unit 10 having a movable core 12 which is connected to one end of a pivoting lever (not shown), the other end of which is fixed in the usual way to a driving element of the meshing device of the engine starter.

The electromagnetic contactor 10 has an external armature or shell 14 which is secured to a support flange 16. A solenoid coil comprises electric windings 20 and 22, fitted around a spool 18 within the interior of the armature 14. One end of the spool 18 is nested on a radial face plate 24 which carries at its centre a fixed core 26. A sliding rod 28, carrying a movable contact 30, passes through the fixed core 26. The movable solenoid core 12 is mounted for sliding movement in a guide tube 32 arranged within the spool 18.

The contactor 10 also has an end closure cap 34 through which fixed terminals or contacts 36 and 38 pass, and to which these latter are fixed.

When the electric windings 20 and 22 are energised, the movable core 12 is displaced towards the right as seen in FIG. 1. A thrust ring 40, which is fixed to the movable core 12, exerts a pushing action on the rod 28 so as to cause the latter to slide axially in the fixed core 26, so that the movable contact 30 makes electrical contact with the two fixed contacts 36 and 38, thereby completing the electrical supply circuit to the starter motor.

Figure 2:
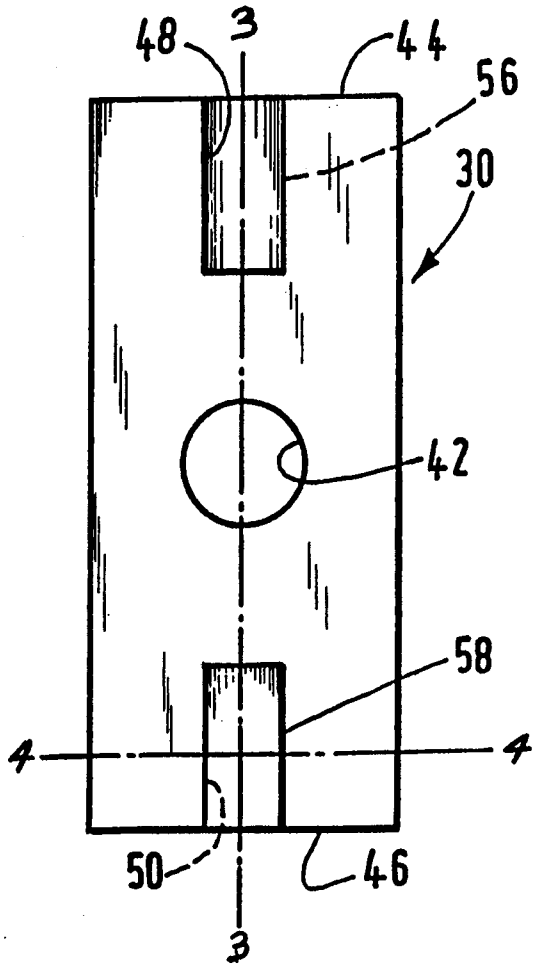
FIG. 2 shows such a movable contact on a larger scale.
Figure 3:
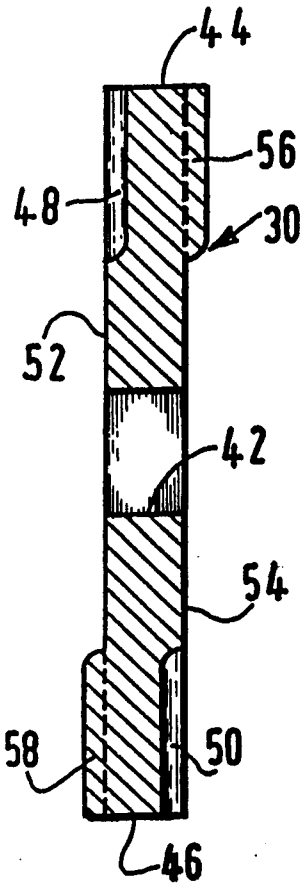
FIG. 3 is a view in cross section taken on the line X—X in FIG. 2.

Reference is now made in particular to FIGS. 2 and 3, which show the constructional details of the movable contact 30. The movable contact 30 is in the general form of a rectangular plate, which is made in an electrically conductive material such as copper. The contact 30 has a central circular hole 42, by means of which the contact 30 is fitted on to a cylindrical support portion 70 (FIG. 1) of the sliding rod 28.

The plate constituting the movable contact 30 defines a central plane of symmetry X—X, which is at right angles to the general axis Y—Y (see FIG. 1) of the contactor unit. The plate terminates, in the direction of this plane of symmetry X—X, in two end faces 44 and 46. Two recesses 48 and 50 are formed in the material of the plate, and are open in the end faces 44 and 46 respectively. One of these recesses, 48, is formed in the back face 52 of the contact 30, while the other recess 50 is formed in its front face 54. The two recesses 48 and 50 extend in the direction of the plane of symmetry X—X, and are centred on it. As is clearly shown in FIG. 1, it is the recess 50 in the front face of the plate which lies in facing relationship with one of the fixed contacts, in this example the fixed contact 38. In other words, the movable contact 30 defines a concave shape 50 in facing relationship with at least one of the fixed contacts 36 and 38.

The recesses 48 and 50 are preferably made by a pressing operation in such a way that in the forming of these recesses, a projection 56 corresponding to the recess 48, and a similar projection 58 corresponding to the recess 50, are formed in the front face 54 and back face 52 of the plate, respectively.

Figure 4:
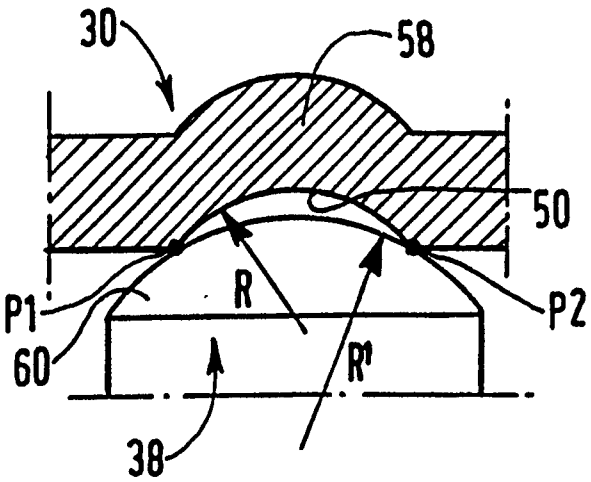
FIG. 4 is a scrap view on a larger scale, in cross section taken on the line A—A in FIG. 2, showing the movable contact in engagement on one of the fixed contacts.

Reference is now made to FIG. 4, which shows part of the movable contact 30 when in contact with the fixed contact 38. The contact 38 has an end portion 60 of generally spherical shape, so that, as shown in FIG. 4, this spherical shape cooperates with the recess 50 to give mechanical contact at two points P1 and P2, instead of a single point of contact as in the prior art. This condition is produced by virtue of the fact that the recess 50 has a circular cross section of radius R which is smaller than the radius R′ of the spherical end portion 60 of the fixed contact 38.

It will of course be understood that each of the two recesses 48 and 50 has a cross section identical to the other, and that the end portions 60 of the respective fixed contacts 36 and 38 also have cross sections identical to each other. With this particular structure, when the movable contact 30 is displaced towards the right as seen in FIG. 1, its electrical contact with the fixed contacts 36 and 38 is ensured firstly by one of its projections 56 making contact with the fixed contact 38, and secondly by one of its recesses, 50, making contact with the other fixed contact 38. As a result, there is three-point contact between the movable contact 30 and the fixed contacts. The three points of contact may vary slightly during operation of the contactor unit, with the movable contact 30 having a slight angular deflection with respect to the main axis Y—Y of the unit.

The present invention is of course not limited to the embodiment described above and/or shown in the drawings, but embraces any variant to which the person normally skilled in this technical field might have recourse. In particular, the general structure of the contactor unit may be different without in any way departing from the spirit of the present invention.

What is claimed is:

1. An internal combustion engine starter contactor, comprising: a housing including a closure cap and defining a general axis of the contactor, two fixed contacts carried by said closure cap, for electrical connection to a starter motor; a movable contact within the housing, the latter including means mounting the movable contact for displacement along said general axis into engagement with said fixed contacts; and a solenoid carried by the housing and comprising an electrical coil and a movable core displaceable in response to the state of energization of the coil so as to urge the movable contact into said engagement with the fixed contacts, the movable contact comprising a plate-like member defining a concave profile in facing relationship with at least one of said fixed contacts and further having two faces, wherein each of said faces defines a recess, wherein each said recess has a circular cross section defining a first radius, each fixed contact having an end portion defining a second radius, with said first radius being smaller than said second radius.

* * * * *